US006159084A

United States Patent [19]

Tiede

[11] Patent Number: 6,159,084

[45] Date of Patent: Dec. 12, 2000

[54] ELECTRICAL HAND-POWER TOOL, IN PARTICULAR HAND GRINDER

[75] Inventor: Steffen Tiede, Stuttgart, Germany

[73] Assignee: Robert Bosch GmbH, Stuttgart, Germany

[21] Appl. No.: 09/307,037

[22] Filed: May 7, 1999

[30] Foreign Application Priority Data

May 9, 1998 [DE] Germany ..... 198 20 873

[51] Int. Cl.[7] ..... B24B 27/08

[52] U.S. Cl. ..... 451/357; 451/359; 451/487; 451/523

[58] Field of Search ..... 451/357, 359, 451/487, 523

[56] References Cited

U.S. PATENT DOCUMENTS

| | | |
|---|---|---|
| 3,345,784 | 10/1967 | Stelljes et al. . |
| 5,398,454 | 3/1995 | Berner . |
| 5,496,207 | 3/1996 | Hornung et al. . |
| 5,679,066 | 10/1997 | Butz et al. . |
| 5,919,085 | 7/1999 | Izumisawa . |
| 5,931,727 | 8/1999 | Schadow . |

FOREIGN PATENT DOCUMENTS

| | | |
|---|---|---|
| 93 20 393 | 7/1994 | Germany . |
| 38 05 326 C2 | 4/1996 | Germany . |
| 195 47 331 A1 | 6/1997 | Germany . |
| 1 345 350 | 1/1974 | United Kingdom . |

*Primary Examiner*—David A. Scherbel
*Assistant Examiner*—Willie Berry, Jr.
*Attorney, Agent, or Firm*—Michael J. Striker

[57] ABSTRACT

An electric hand power tool has a rotatable workshaft, a tool driveable by the rotatable work shaft and performing a movement selected from the group consisting of a rotary movement, a circulatory movement and an oscillating movement, an eccentric pin which is fixedly connected with the work shaft, a tool holder which receives the tool, a rotary bearing through which the tool holder is mounted on the eccentric pin, the eccentric pin and the rotary bearing being formed as an integrated component of the tool holder, and the tool holder being exchangeably coupleable with the work shaft.

18 Claims, 3 Drawing Sheets

ELECTRICAL HAND-POWER TOOL, IN PARTICULAR HAND GRINDER

BACKGROUND OF THE INVENTION

The present invention relates to electrical hand power tools with a tool which is driven by a rotatable drive shaft and performs a rotating, circular and/or oscillating movement. More particularly it relates to a hand grinder provided with a grinding tool.

Electrical hand power tools of this type are known in the art and formed as scrapers, filers and grinders, in particular delta grinders, eccentric grinders, combi grinders, oscillations grinders, etc. for different grinding works. An electrical scraper is disclosed for example in the German patent document DE 195 47 331 A1, and a delta grinder is disclosed for example in the German patent document DE 93 20 393 A1.

In hand grinders in particular for obtaining optimal grinding results different oscillations circles are needed to be considered in the design of the machines. For example, the delta grinder operates conventionally with a grinding circle of approximately 1–2 mm, the oscillations grinder operates with an oscillation circle approximately 2–3 mm, and the eccentric grinder operates with an oscillation circle of approximately 3–9 mm. In hand grinders which must be used for different grinding operations, for example in so-called multifunction grinders, a compromise in the design of the oscillations circle is provided, which does not represent an optimum for no grinding operations at all or only at most for one of the grinding operations.

SUMMARY OF THE INVENTION

Accordingly, it is an object of the present invention to provide an electric hand power tool which avoids the disadvantages of the prior art.

In keeping with these objects and with others which will become apparent hereinafter, one feature of present invention resides, briefly stated, in an electric hand power tool, in which an eccentric pin with a rotary bearing which supports a tool holder on the eccentric pin together form an integrated component of the tool holder, and the tool holder is alternatingly coupled on the drive shaft.

In the inventive electric hand power tool due to the integration of the eccentricity in the tool holder and its design to be easily separable from the electric hand power tool, there is a possibility to design the corresponding tool holder with the optimal eccentricity for the special working operations, in particular grinding operations, and by exchanging the tool holder the consumer has the possibility to perform with the same electric hand power tool various operations with always the best possible working efficiency. For example with a tool holder which is designed for oscillation grinding a good surface is provided and with a tool holder designed for the eccentric grinder a high material removal is provided.

Since conventionally on the work shaft or in impeller which is fixedly connected with the work shaft a compensation weight is provided for compensation of the imbalance of the tool holder, in accordance with a preferable embodiment of the invention, the mass of the tool holder and its center of gravity are adjusted to the compensation weight to guarantee the balancing of the entire electric hand power tool.

In accordance with an alternative embodiment of the present invention, the compensation weight is arranged on the tool holder or partially in the tool holder and in the machine.

The inventive electric hand power tool can be also provided with a tool holder, in which the eccentricity between the axes of the eccentric pin and the work shaft is zero. In this case, the rotary bearing can be dispensed with, and instead of the rotary bearing a balancing can be provided in the tool holder, which is determined by the compensation weight on the work shaft. The tool holder can be formed then as a simple, rotatable grinding plate which rotates about the axis of the work shaft and can be used for any grinding and separating operations, for example as an angular grinder.

In accordance with a preferable embodiment of the present invention, an electric hand power tool is provided with a dust aspiration, in which an impeller wheel of a suction ventilator or a suction blower is driven from the drive shaft connecting the tool holder with the air impeller. For this purpose the eccentric pin is provided with an axial throughgoing opening which is offset relative to the bearing axis of the rotary bearing in the tool holder by an eccentric value, for passing a mounting screw. The impeller hub is provided with an inner thread which is coaxial to the axis of the impeller hub and the working shaft for screwing in of the mounting screw.

In addition in accordance with a preferable embodiment of the invention, at the end side of the eccentric pin which faces the impeller hub, at least one driver is provided which is form-lockingly received in at least one receptacle formed in the end side of the impeller hub. Therefore, not only a force-transmitting connection between the impeller wheel and the eccentric pin is provided, but also a form-locking driving connection of the eccentric pin is guaranteed through the impeller wheel, as well as the proper positioning of the tool holder to the compensation weight.

In accordance with a preferable embodiment of the invention, the tool holder has a disk or plate-shaped support, provided with an eccentric plate, a rotation plate, or a oscillations plate on its flat lower side, and a bearing cup which receives the rotary bearing on its upper side. For realization of a tool holder which is only vibrating, in accordance with a further embodiment of the present invention, the support of the tool holder is non rotatably held by elastic oscillation elements.

For obtaining a purely linear oscillation movement, in accordance with a preferable embodiment of the invention the rotary bearing is arranged in the bearing cup so that it takes along the support in one direction and is freely moveable in a transverse direction in the bearing cup. In order to guarantee in this case a compensation of electric hand power tool which operates as a linear oscillations grinder, in accordance with a preferable embodiment of the invention a compensation mass is arranged on the support of the tool holder. It is formed displaceably in direction of the linear oscillations of the support within fixed limits.

This is realized in accordance with the preferable embodiment of the invention in a simple manner so that trough-shaped passages are provided on the rear side of the support at both sides of the bearing cup and extend in direction of the linear oscillations, and several mass balls which are freely movable in the longitudinal direction are inserted in them.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
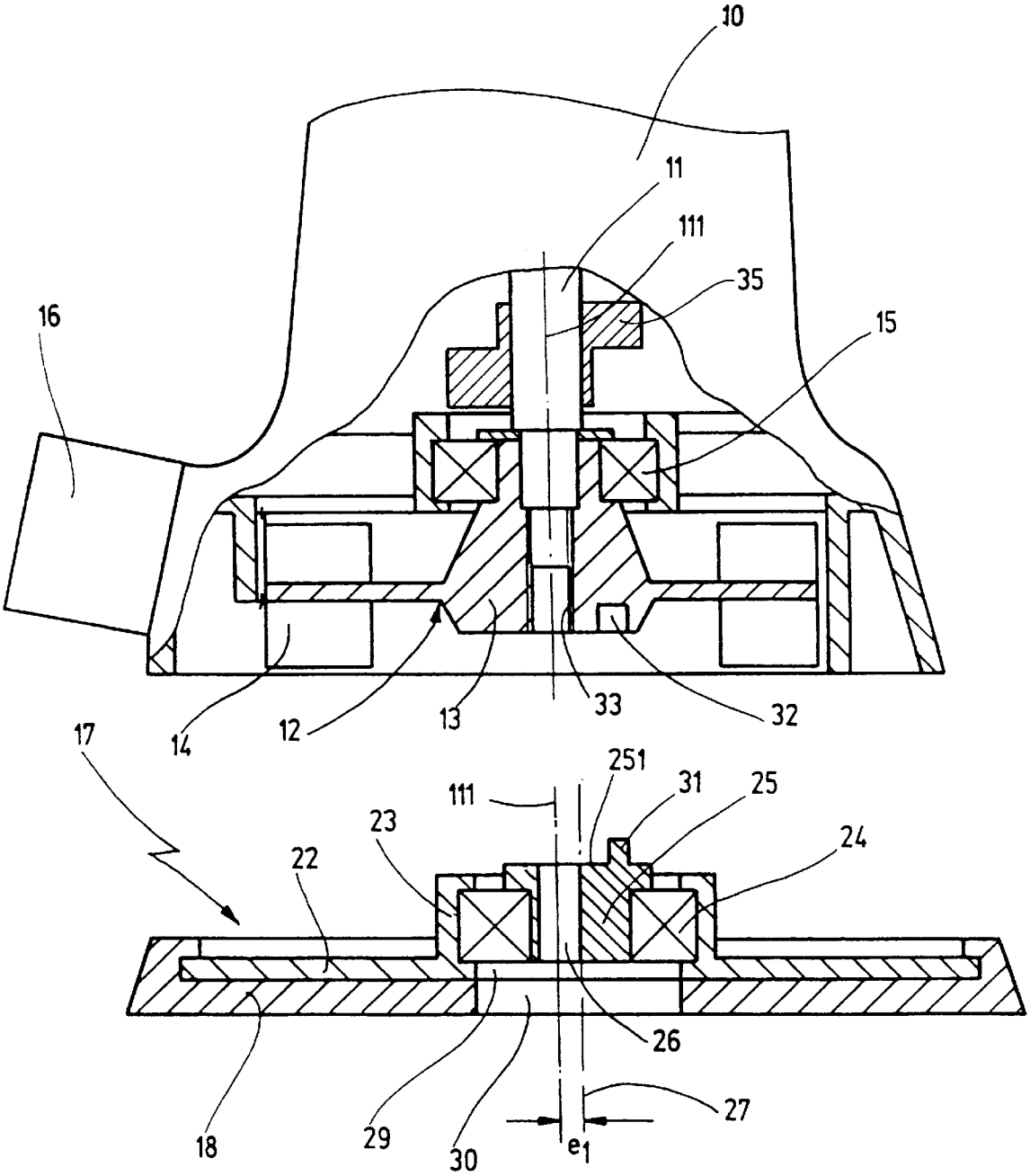
FIG. 1 is a side view of an electric hand grinder with a removed eccentric plate, partially in section.

FIG. 1 shows a partially sectioned side view of an electric hand grinder as an example of a general electric hand power tool with a rotatable, circulating and/or oscillating tool. It has a machine housing 10 in which an electric motor is accommodated and drives a work shaft 11. It further has an aspiration blower for aspiration of the grifing dust. Its blower or impeller wheel 12 is non rotatably supported on a free end of the work shaft 11. The work shaft 11 is rotatably supported in the machine housing. The impeller wheel 12 has an impeller hub 13 which is fitted on the end of the work shaft, and radially projecting impeller vanes 14. It is supported in the machine housing 10 through a rotary bearing 15. A connecting pipe 16 for a dust catching bag is formed near the impeller wheel 12 on the machine housing 10. It forms a pressure outlet of the aspiration blower.

For performing different grinding works, the hand grinder is provided with different tool holders 17. The tool holder 17 shown in FIG. 1 has an eccentric plate 18, the tool holder 17 shown in FIG. 2 has an oscillation plate 19, the tool holder 17 shown in FIG. 3 has a rotation plate 20, and the tool holder 17 shown in FIGS. 4 and 5 has a linear oscillation plate 21. As not shown here, each plate 18–20 and also the oscillation plate 21 is provided with an adhesive coating for mounting of a grinding means.

The tool holder 17 has a disk shaped or plate-shaped support 22. A bearing cup 23 is formed on the plate 18 or the oscillation plate 19 or the rotation plate 20 or the linear oscillation plate 21 on its lower side which faces away from the machine housing 10, and on its upper side which faces toward the machine housing 10. A schematically shown rotary bearing 24 is received in the bearing cup 23. It can be formed as a grooved spherical bearing with an inner bearing ring and an outer bearing ring and balls located therebetween. The inner bearing ring is immovably arranged on an eccentric pin 25 which is provided with a throughgoing opening 26 with an eccentricity E to the axis 27 of the rotary bearing or the pin. The throughgoing opening 26 serves for insertion of a mounting means formed here as a head screw 28 shown in FIGS. 2–4.

For plugging the head screw 28 a recess 29 or 30 is provided coaxial with the rotary bearing or the pin axis 27 for plugging of the head screw 28 in the support 22 and in the corresponding plate 18–20 or the oscillation plate 21. The eccentric pin 25 which has a T-shape in a longitudinal section extends with its end flange 251 through a coaxial opening 30 in the cup bottom of the bearing cup 23. A drive pin 31 as formed on the end flange 251 with a radial distance from the pin axis 27. It axially projects from the end flange 21 and can form-lockingly engage into a recess 32 which is formed in the free end side of the impeller hub 13.

Figure 2:
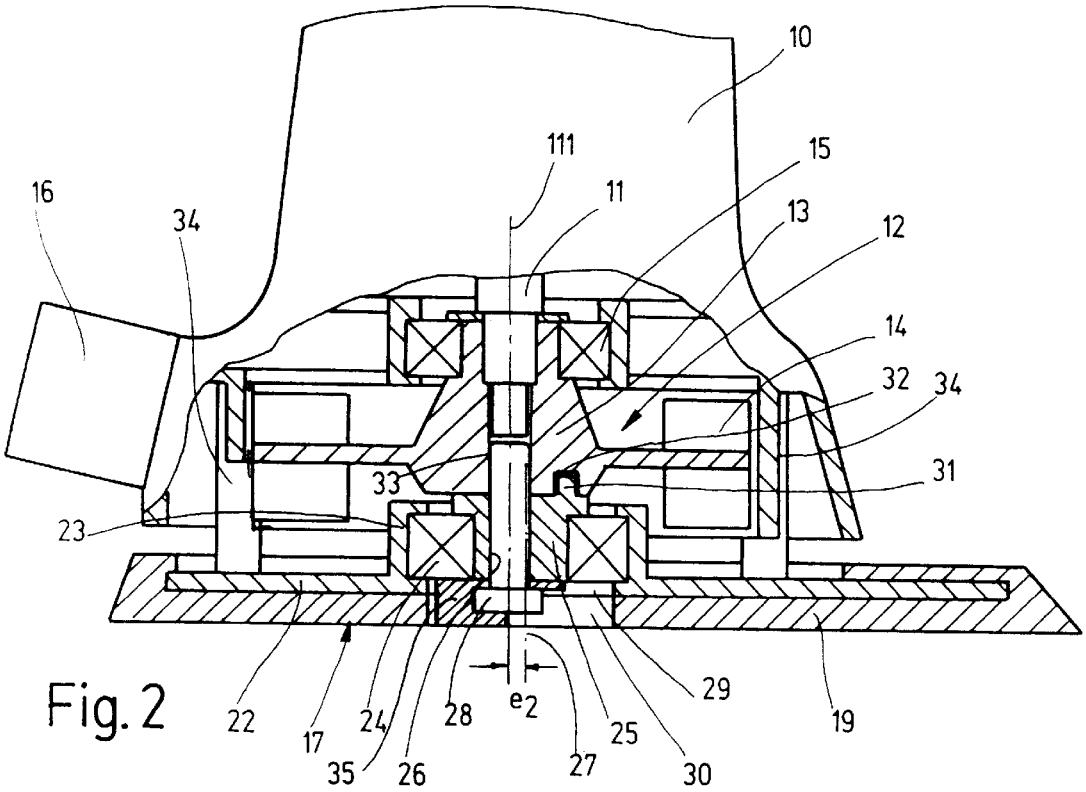
FIG. 2 is a view substantially corresponding to the view of FIG. 1 but showing the hand grinder with the mounted oscillation plate.

For connecting of the tool holder 17 with the hand grinder as shown in FIG. 2, the tool holder 17 is mounted on the impeller wheel 12. For this purpose the end flange 251 of the eccentric pin 25 is placed on the impeller hub 13 so that the drive pin 31 engages in the recess 32. Then the head screw 28 passes through the throughgoing opening 26 and is screwed into an inner thread 33 of the impeller hub 13 which is coaxial to the axis 111 of the work shaft 11. Alternatively the head screw 28 can be directed screw into a corresponding threaded opening in the work shaft 11. Also, the work shaft 11 can be formed so long that it is fitted with a threaded portion over the work shaft 11 and projects with the drive pin 31 into the eccentric pin 35 engaging in the impeller hub 13. The nut which is screwed in the threaded portion tensions the eccentric pin 25 axially on the impeller wheel 12 which in turn is supported on a ring shoulder formed on the work shaft 11. By corresponding extension of the throughgoing opening 26 for the rotary bearing or pin axis 27 of the eccentric pin 25, each tool holder 17 can be provided with different eccentricity. Thus, the tool holder 17 which carries the eccentric plate 18 has a greater eccentricity $E_1$ which amounts to between 3–9 mm. This tool holder 17 serves for eccentric grinding and provides a great grinding material removal of the workpiece.

The tool holder 17 in FIG. 1 is designed with a smaller eccentricity $e_2$, which, depending on whether it is used for the oscillation plate 19 as a delta grinder or oscillating grinder, amounts to approximately 1–2 mm, or approximately 2–3 mm. In addition, elastic oscillation elements 34 are mounted on the support 22. They project from the rear side of the support 22 which supports the bearing cup 23 and non rotatably fixed in the machine housing 10 during placing of the tool holder 17 on the impeller hub 13 at its free end. The oscillation elements 38 hinder the rotary movement of the oscillation plate 19 lead to an oscillating movement with a predetermined eccentricity.

As can be seen from FIG. 1, a compensating weight 35 is arranged on the work shaft 11 for compensation of the imbalance of the tool holder 17. The compensation web 35 is axially non displaceably and non rotatably connected with the work shaft 11. The compensating weight can be supported in the impeller wheel 12 and formed for example on the impeller vanes 14. In order to guarantee a balancing of the whole hand grinder with various tool holders 17, the masses of all tool holders 17 and their points of gravity are determined on the compensating weight 35. The mass $m_W$ of the different tool holders 17 and the mass $m_A$ of the compensation weight 35 are determined with consideration of their corresponding eccentricities $e_W$ and $e_A$, in accordance with the following $m_W \cdot e_W = m_A \cdot e_A$. Alternatively, the compensating weight 35 can be integrated in the tool holder 17 and in particular on the eccentric pin 35 as shown in FIG. 2. In this case, the compensating weight 35 is exchanged together with the tool holder exchange. The compensation weight on the eccentric pin 25 can be provided additionally to the compensation weight 35 on the work shaft or the impeller wheel 12, so that it can compensate only the mass difference of the different tool holders 17 and therefore can be made small.

Figure 3:
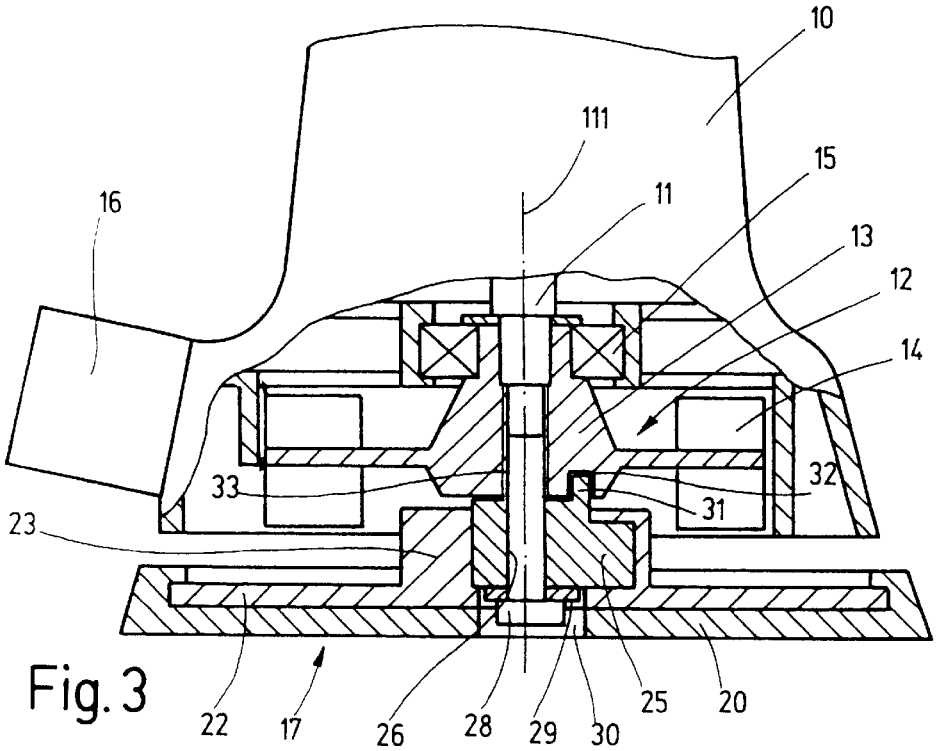
FIG. 3 is a view substantially corresponding to the view of FIG. 1, but showing the hand grinder with the mounted rotation plate.

In the hand grinder shown in FIG. 3, the eccentricity e in the tool holder 17 is zero, so that the tool holder 17 exclusively rotates. Moreover, the grinding disk or separating disk are mounted on the rotation plate 20, and the hand grinder is used as an angular grinder or separating grinder. In this case, the rotary bearing must be mounted at a distance and fixedly with the eccentric pin 25' in the bearing cup 23. Advantageously, the eccentric pin 25' is designed so that it forms a counter mass to the compensating weight 35 on the work shaft 11, to guarantee the balancing of the hand grinder.

Figure 4:
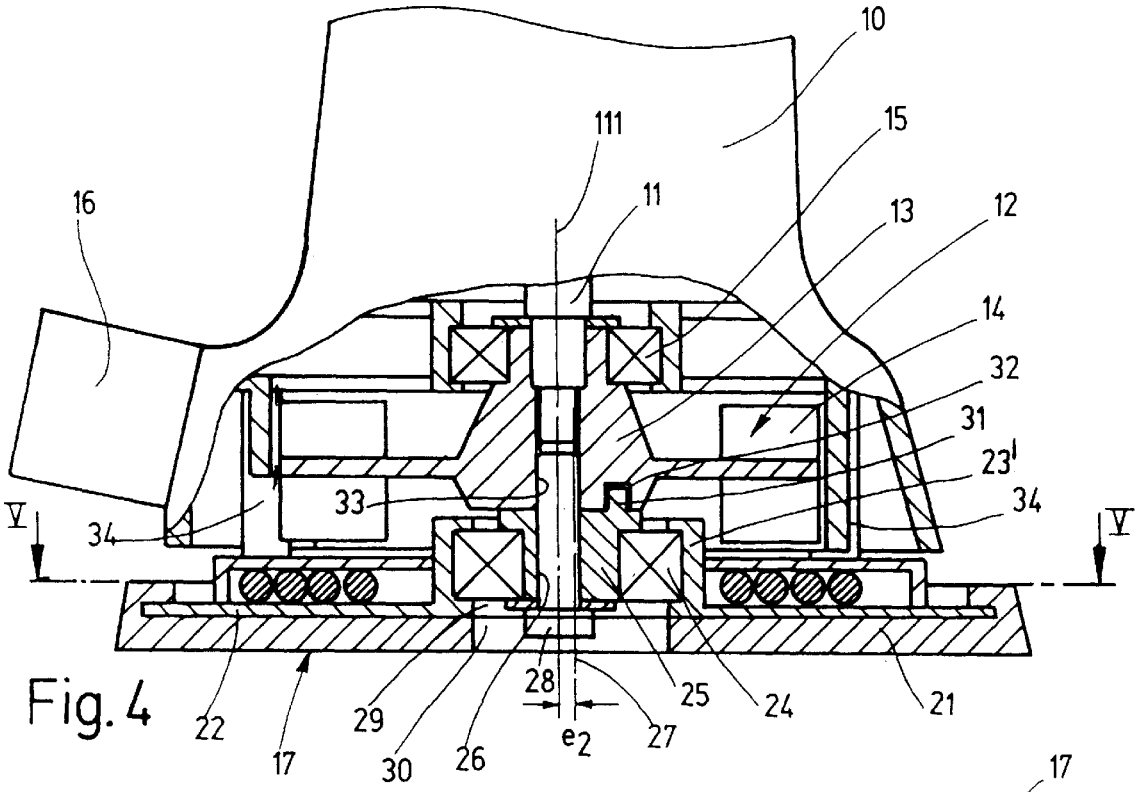
FIG. 4 is a view substantially corresponding to the view of FIG. 1, but showing the hand power tool with the mounted linear oscillation plate.
Figure 5:
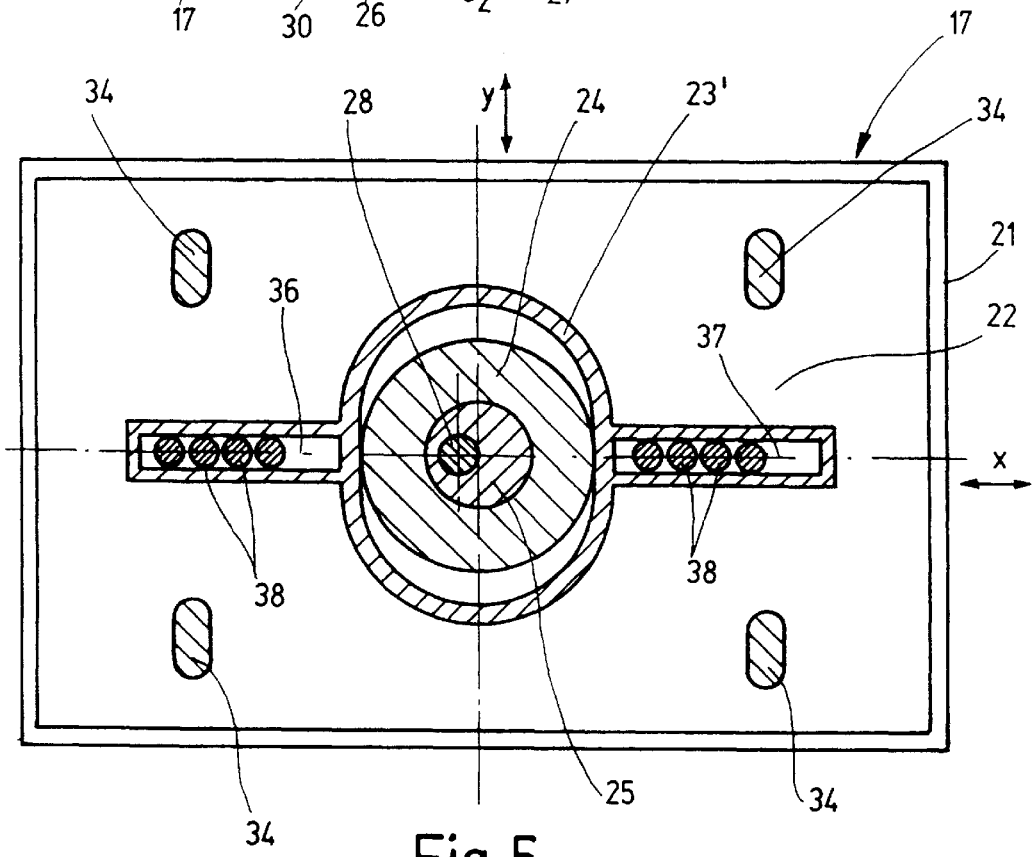
FIG. 5 is a view showing a section taken along the line V—V in FIG. 4.

In the hand grinder shown in FIGS. 4 and 5, the tool holder 17 is formed so that it forms a linear oscillation grinder with the hand grinder connected to the holder 17. The grinding tool here exclusively performs a linear oscillation movement in x direction as shown in FIG. 5. For this purpose elastic oscillation elements 35 are arranged on the rear side of the plate-shape support 22, similarly to the disk-shaped support 25 in FIG. 2. During placing of the tool holder 17 on the impeller hub 13, they engage in the machine housing 10 and they are non rotatably fixed at their free end. Moreover, the bearing cup 23' is formed differently from the bearing cup 23 in FIG. 2, so that it has an oval or an elliptical light cross-section with a smaller light diameter corresponding to the outer diameter of the rotary bearing 24 and a greater diameter which is greater than the outer diameter of the rotary bearing 24 by at least double eccentricity $e_2$ in FIG. 4. The schematically shown rotary bearing 24 has, as described above, an inner bearing ring which is fixedly mounted on the eccentric pin 25, and an outer bearing ring which is inserted in the bearing cup 23 and supported on the inner cup wall of the bearing cup 23'. When the work shaft 11 rotates, the support 22 through the rotary bearing 26 and the bearing cup 22' is driven in x-direction, while the rotary bearing 26 is freely movable in y-direction inside the bearing cup 22'. Thereby no transverse forces are act in y-direction on the bearing cup 22' and thereby on the support 22.

In order to guarantee the balancing of the hand grinder provided with the compensation weight 35, a compensation mass is arranged on the support 22. It is formed displaceably in direction of the smallest diameter of the bearing cup 23' (x direction in FIG. 5) by at least the eccentricity $e_2$. For this purpose, the support 22 is provided on its rear side which carries the bearing cup 23' with two groove-shaped passages 36 and 37. The passages extend in the x direction and proceed directly from the outer contour of the bearing cup 23' outwardly. Mass balls 38 are inserted in each of the passages 36 and 37. The mass balls are displaceably guided in the passages 36, 37 in the x direction.

It will be understood that each of the elements described above, or two or more together, may also find a useful application in other types of constructions differing from the types described above.

While the invention has been illustrated and described as embodied in electrical hand-power tool, in particular hand grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. An electrical hand power tool, comprising a rotatable workshaft; a tool driveable by said rotatable work shaft and performing a movement selected from the group consisting of a rotary movement, a circulatory movement and an oscillating movement; an eccentric pin which is fixedly connected with said work shaft; a tool holder which receives said tool; a rotary bearing through which said tool holder is mounted on said eccentric pin, said eccentric pin and said rotary bearing being formed as an integrated component of said tool holder, and said tool holder being exchangeably coupleable with said work shaft; and an aspiration blower provided for dust aspiration and having a blower wheel fixedly mounted on the work shaft, said tool holder being fixedly connected with said blower wheel.

2. An electric hand power tool as defined in claim 1; and further comprising a impeller wheel of an aspiration blower fixedly mounted on the work shaft for dust aspiration, said tool holder being fixedly connected with said impeller wheel.

3. An electric hand power tool as defined in claim 2, wherein said impeller wheel has impeller hub and an impeller vanes radially projecting from said impeller hub, said impeller wheel fixedly sitting with said impeller hub on said work shaft, said eccentric pin being fixedly connected with said impeller hub.

4. An electrical hand power tool, comprising a rotatable work shaft; a tool driveable by said rotatable work shaft and performing a movements elected from the group consisting of a rotary movement, a circulatory movement and an oscillating movement; an eccentric pin which is fixedly connected with said work shaft; a tool holder which receives said tool; a rotary bearing through which said tool holder is mounted on said eccentric pin, said eccentric pin and said rotary bearing being formed as an integrated component of said tool holder, and said tool holder being exchangeably coupleable with said work shaft; a impeller wheel of an aspiration blower fixedly mounted on the work shaft for dust aspiration, said tool holder being fixedly connected with said impeller wheel, said impeller wheel having impeller hub and an impeller vanes radially projecting from said impeller hub, said impeller wheel fixedly sitting with said impeller hub on said work shaft, said eccentric pin being fixedly connected with said impeller hub said eccentric pin having an axially throughgoing opening which is offset relative to an axis of said rotary bearing by an eccentricity for insertion of a screw, said impeller hub being provided with an inner thread which is coaxial to an axis of said impeller hub and said work shaft and used for screwing in of said screw.

5. An electric hand power tool as defined in claim 4, wherein an end side of said eccentric pin which faces said impeller hub is provided with a driver which extends perpendicularly to said impeller hub and radially to an axis of said eccentric pin, said impeller hub having an end side provided with a recess in which said driver is form-lockingly engaged.

6. An electrical hand power tool, comprising a rotatable work shaft; a tool driveable by said rotatable work shaft and performing a movement selected from the group consisting of a rotary movement, a circulatory movement and an oscillating movement; an eccentric pin which is fixedly connected with said work shaft; a tool holder which receives said tool; a rotary bearing through which said tool holder is mounted on said eccentric pin, said eccentric pin and said rotary bearing being formed as an integrated component of said tool holder, and said tool holder being exchangeably coupleable with said work shaft; and a compensating weight which is fixedly mounted on said work shaft for compensation of a weight of said tool holder.

7. An electrical hand power tool, comprising a rotatable work shaft; a tool driveable by said rotatable work shaft and performing a movement selected from the group consisting of a rotary movement, a circulatory movement and an oscillating movement; an eccentric pin which is fixedly connected with said work shaft; a tool holder which receives said tool; a rotary bearing through which said tool holder is mounted on said eccentric pin, said eccentric pin and said rotary bearing being formed as an integrated component of said tool holder, and said tool holder being exchangeably coupleable with said work shaft; and a compensating weight which is fixedly mounted on said tool holder for compensation of a weight of said tool holder.

8. An electrical hand power tool, comprising a rotatable work shaft; a tool driveable by said rotatable work shaft and performing a movement selected from the group consisting of a rotary movement, a circulatory movement and an oscillating movement; an eccentric pin which is fixedly connected with said work shaft; a tool holder which receives said tool; a rotary bearing through which said tool holder is mounted on said eccentric pin, said eccentric pin and said rotary bearing being formed as an integrated component of said tool holder, and said tool holder being exchangeably coupleable with said work shaft, said tool holder having a support having a flat lower side on which an element selected from the group consisting of a grinding plate, a rotation plate and an oscillating plate is formed, and an upper side on which a bearing cup for receiving of a rotary bearing is formed.

9. An electric hand power tool as defined in claim 8, wherein said support is a plate-shaped support.

10. An electric hand power tool as defined in claim 8, wherein said support is a disk-shaped support.

11. An electric hand power tool as defined in claim 10, wherein said rotary bearing is arranged in said bearing cup so that it takes along said support in a direction x and is freely movable in said bearing cup in a transverse direction.

12. An electric hand power tool as defined in claim 11, wherein said bearing cup has an inner cross-section with a smaller diameter than is significantly greater than an outer diameter of said rotary bearing, and also has a greater diameter which is perpendicular to it and which is greater than the outer diameter of the rotary bearing by at least a double eccentricity between axes of said rotary bearing and said work shaft.

13. An electric hand power tool as defined in claim 12, and further comprising a balancing mass which is formed displaceably in direction of a smallest diameter of said bearing cup by at least a double eccentricity value.

14. An electric hand power tool as defined in claim 13, wherein said balancing mass is arranged on said support.

15. An electric hand power tool as defined in claim 12, wherein said bearing cup has an oval cross-section.

16. An electric hand power tool as defined in claim 12, wherein said bearing cup has an elliptical cross-section.

17. An electric hand power tool as defined in claim 8; and further comprising elastic oscillation elements with which said support is non rotatably fixed.

18. An electrical hand power tool, comprising a rotatable work shaft; a too driveable by said rotatable work shaft and performing a movement selected from the group consisting of a rotary movement, a circulatory movement and an oscillating movement; an eccentric pin which is fixedly connected with said work shaft; a tool holder which receives said tool; a rotary bearing through which said tool holder is mounted on said eccentric pin, said eccentric pin and said rotary bearing being formed as an integrated component of said tool holder, and said tool holder being exchangeably coupleable with said work shaft; and an aspiration blower provided for dust aspiration and having a blower wheel fixedly mounted on the work shaft, said tool holder being fixedly connected with said blower wheel.

* * * * *